United States Patent [19]

Allen et al.

[11] Patent Number: 4,728,537

[45] Date of Patent: Mar. 1, 1988

[54] ORE PELLETIZATION

[75] Inventors: Anthony P. Allen, Leeds, England; Sten Forsmo, Malmberget, Sweden; John G. Langley, Shipley, England

[73] Assignee: Allied Colloids Limited, Great Britain

[21] Appl. No.: 55,701

[22] Filed: May 29, 1987

Related U.S. Application Data

[63] Continuation-in-part of Ser. No. 935,006, Nov. 26, 1986, Pat. No. 4,684,549.

[30] Foreign Application Priority Data

Nov. 29, 1985 [GB] United Kingdom ..... 8529418
Mar. 24, 1987 [GB] United Kingdom ..... 8706932

[51] Int. Cl.[4] ..... B05D 7/00; C22C 1/04; H01F 1/02

[52] U.S. Cl. ..... 427/221; 75/0.5 BA; 148/105; 427/127

[58] Field of Search ..... 75/0.5 BA; 148/105; 427/127, 221

[56] References Cited

U.S. PATENT DOCUMENTS

| | | | |
|---|---|---|---|
| 4,050,962 | 9/1977 | Koester et al. | 75/0.5 BA |
| 4,248,907 | 2/1981 | Uehori et al. | 148/105 X |
| 4,470,844 | 9/1984 | Rademachers | 75/0.5 BA |
| 4,543,208 | 9/1985 | Horie et al. | 148/105 X |

*Primary Examiner*—Michael R. Lusignan
*Attorney, Agent, or Firm*—Ostrolenk, Faber, Gerb & Soffen

[57] ABSTRACT

Finely divided mineral ore is pelletized using a soluble synthetic polymer. Preferably the polymer is in the form of beads made by reverse phase polymerization and all having a size of below 300 μm. When the ore gives a pH in water of below 8 the soluble polymer is preferably cationic.

22 Claims, No Drawings

ORE PELLETIZATION

This application is a continuation-in-part of application Ser. No. 935,006 filed Nov. 26, 1986, now U.S. Pat. No. 4,684,549, patented Aug. 4, 1987.

Iron ore needs to be in the form of agglomerates of substantial size when it is charged into a blast furnace. If the available ore is in the form of particles that are too small for direct feed to the blast furnace it is necessary to convert them to a sinter or to pellets. With the increasing use of lower grade ores it has become necessary to grind the ore more finely and, for these fine particles, pelletisation is the only satisfactory method of production of feedstock for the furnaces.

The pellets are made by adding binder to the fine particulate ore and stirring in the presence of a small amount of water (generally moisture in the ore) to form a moist mixture, and then pelletising the mixture, e.g., in a balling drum or disc pelletiser. The green pellets are then fired in a kiln through a temperature range that extends from an inlet temperature typically in the range 200°–400° C. up to a final temperature of e.g., 1200° C.

Important properties of the pellets are the initial or wet strength, the dry strength (after drying the green pellets in an oven at 105° C.) and the tendency of the pellets to spall (or burst) upon exposure to firing temperatures. The tendency for spalling can be defined by determining the minimum temperature at which spalling occurs or by observing the percentage of fines formed during a particular firing cycle. The moisture content of the mixture and the porosity of the pellets must be chosen carefully. A high "drop number" for the green pellets is desirable. For cost reasons the amount of binder should be as low as possible and, to ensure uniform properties, its flow properties must be such that it can easily be added uniformly in these low quantities.

Although many binders have been proposed in the literature, (e.g., bentonite and other clays, ferrous sulphate, lignin sulphate, asphalt, starches, calcium and sodium compounds, and certain polymers) in practice bentonite is the binder that is generally used.

In GB No. 1,324,838 work was described that was conducted in or before 1970, more than 15 years ago. This used, as binder, a water soluble linear organic polymer having a molecular weight of 1 million to 20 million. Suitable polymers were modified natural polymers such as starch and sodium carboxymethyl cellulose and various non-ionic, anionic or cationic synthetic polymers. The process involved forming a solution of the polymer and spraying the solution on to the particulate iron ore. The patent noted that the sprayed solution was viscous and that this could be a problem, but that the viscosity could be reduced by including sodium chloride, sodium sulphate or potassium chloride in the water used for making the solution.

Although direct comparisons of the polymers in GB No. 1,324,838 is difficult it appears from the patent that various non-ionic, anionic and cationic polymers can be used to give improved green strength and/or spalling properties compared to bentonite, at very much lower dosages than bentonite. For instance a straight chain polyethylene oxide was reported as giving improved strength and spalling values and a cationic copolymer and a polymer formed from about 8% sodium methacrylate and 92% acrylamide were reported as giving improved strength values.

A disadvantage of the process in GB No. 1,324,838 is that it is necessary to introduce substantial amounts of water with the polymer and so the initial iron ore must be very dry (involving the use of drying energy) or the final pellets will be very wet (increasing the risk of spalling).

In Aus.I.M.M. Newcastle Pellets and Granules Symposium October 1974 pages 151 to 156 R. L. Smythe describes what appears to be the same work as is discussed in this patent. It describes the problems that had been incurred with converting dry powder polymer into the polymer solution that could be sprayed on to iron ore. The article proposed the use of polymer supplied as a 35% solution (necessarily therefore involving bulk handling problems) and the use of polymer supplied as a liquid suspension, that presumably was converted to an aqueous solution before use. The article warned about handling problems of the resultant pellets and the risk of blockage of chutes and referred to the study of alternative polymers, namely "natural polymers and derivatives of petroleum products".

Despite all this work in the early 1970's an authoritative review of iron ore pelletisation by G. K. Jones in Industrial Minerals March 1979 pages 61 to 73 mentions, as binders, only Portland cement, lime and bentonite, and emphasises the large amount of bentonite that is used and predicts that it will continue to be used despite the shortages of bentonite.

Despite the acceptance by Jones, and the whole industry, that bentonite would continue to be the most widely used binder it has, for very many years, been recognised to incur various problems. Thus some grades of bentonite give satisfactory pellet properties but others are less satisfactory. A problem with all grades of bentonite is that the bentonite is not combustible and so contributes to the gangue in the furnace, and this gangue tends to be corrosive to the lining of the furnace. Another problem with bentonite is that the optimum grades are becoming less available. Bentonite must be present in the pellets in quite large amounts, thus reducing the iron content of the pellet significantly and increasing the amount of gangue. Lime and some inorganic salts have been proposed as alternatives to bentonite, but again they cause the formation of unwanted gangue and can be less satisfactory than bentonite. The added gangue constituents require increased energy consumption in the furnace.

A problem with bentonite and other binders is that the spalling temperature is low. Typically the inlet temperature of the kiln has to be in the range 200° to 400° C. to prevent spalling. Higher inlet temperatures would be economically desirable if spalling could still be avoided.

In Mining Engineering October 1984 pages 1437 to 1441 de Souza et al reported that organic binders would have the inherent advantage, over inorganic binders, of being eliminated during firing. Results were reported on the use of polymers based on cellulose, in particular the material sold under the trade name Peridur and which is believed to be carboxymethyl cellulose. The article reported adding Peridur powder to an aqueous pulp of iron ore before filtration and also reported adding the powder manually to the ore flow. The article noted the need for water soluble polymers to be hydrated and dissolved during mixing and pelletising. Spalling at 250° C. was reported, but this is unsatisfactorily low.

A difficulty with powdered cellulosic binders such as carboxymethyl cellulose is that the irregular particle shape and size distribution is such that the powder does not flow freely. Instead the dry particles tend to clump together rather than flow over one another. As a result it is difficult to achieve uniform supply of the low dosages that are required. Another problem is that the amount of cellulosic binder that has to be used for adequate strength tends to be too high to be cost effective. Another problem with some cellulosic polymers is that they can reduce surface tension, and this appears to be undesirable in pellet formation.

In practice the use of cellulosic binders has not been widely adopted, presumably because of these or other problems. At present therefore there is very little use of organic binders and bentonite is still very widely used, despite the long-recognised disadvantages and decreasing availability of suitable grades of bentonite and despite the long-established possibility of using organic binder.

In EP No. 0203855A2 (not published until after the priority date of this application) it is proposed to use a water soluble high molecular weight polymer in the form of a dry powder or, preferably, a water-in-oil emulsion.

Spalling properties are not discussed in a manner that allows judgement as to whether these polymers could give improved spalling properties compared to the spalling properties of bentonite.

The only dry powders that are specifically proposed in EP 0203855A2 are Rhone Poulenc AD10 which is said to be a non-ionic polyacrylamide having intrinsic viscosity (IV) 15.4 dl/g and which we believe to be a coarse crushed gel product, and Percol 725 and Percol 726, both of which are made by the assignees of the present application. Percol 725 is a crushed gel copolymer having IV about 18 of 80% acrylamide and 20% by weight sodium acrylate and Percol 726 is a bead copolymer of about 65% acrylamide and 35% by weight sodium acrylate and has IV about 17. In particular the bead form of Percol 726 is made by reverse phase polymerisation and a significant amount of the particles have a dry size above 450 μm and up to about 800 μm, and the crushed gel of Percol 725 also has a particle size of up to about 800 μm.

When considering possible binders that might be used there are several critical factors that have to be recognised. The iron ore always has a very small particle size, and therefore a huge surface area. The binder must be introduced with the absolute minimum of water in order that the pellets can conveniently have a total moisture content of not more than about 15%. The duration and energy of mixing the binder with the iron ore particles must be as short as possible in order to maximise production and minimise capital costs. The amount of binder must be as low as possible in order to minimise cost and to avoid the risk of excess binder accentuating the stickiness problems noted in the article by R. L. Smythe.

Bentonite has a very small particle size (typically below 10 μm) and adequate admixture of these very small particles with the particulate iron ore is achieved because the bentonite is used in a relatively large amount (typically 1%). However it would be expected that the use of a binder that is substantially coarser and/or present in a substantially smaller amount would tend to give less satisfactory results, due to non-uniform mixing of the binder with the relatively large volume of very fine particulate iron ore.

The use of cellulosic binders or the powder or emulsion binders proposed in EP No. 0203855A2 is inconvenient from the point of view of application methods that give reasonable results. Also the results are, at best, generally no better than those obtainable with bentonite, and they are often worse. It has been our object to improve application methods and/or obtain better results.

In the methods of the invention mineral ore pellets are made by adding binder comprising organic polymer to particulate mineral ore having substantially all particles below 250 μm and stirring in the presence of about 5 to about 15% by weight water (based on total mixture) to form a substantially homogeneous moist mixture and pelletising the moist mixture.

In copending application Ser. No. 935,006 filed Nov. 26, 1986 by the present applicants, the entire disclosure of which is herein incorporated by reference, the mineral ore is iron ore and the binder comprises about 0.01 to about 0.2% by weight based on total mixture of a water soluble synthetic polymer that has IV about 3 to about 16 and that is an anionic polymer of one or more water soluble ethylenically unsaturated monomers comprising an anionic monomer and that is added to the iron ore as dry, free flowing, beads having substantially all particles below about 300 μm.

In one aspect of the invention the binder comprises about 0.005% to about 0.5% by weight, based on total mix, of a water soluble synthetic polymer that is added to the ore as dry, free flowing, beads that are substantially all above 20 μm and below 300 μm and that are made by reverse phase bead polymerisation from a water soluble ethylenically unsaturated monomer or blend of monomers.

We find that the use of these very small beads, instead of the coarse and/or irregular powders or solutions that have been used previously in the literature, permits very easy and accurate application without adding water and can give excellent results. For instance it is possible to select the ore and polymer such that good spalling properties can be achieved using very easy application procedures.

Reverse phase bead polymerisation is a well known process. Thus an aqueous solution of the chosen monomer or monomer blend is dispersed in water immiscible liquid, generally in the absence of an emulsifying agent but often in the presence of an amphipathic polymeric stabiliser, the polymerisation is induced in conventional manner to provide a suspension of gel particles in the non-aqueous liquid, the suspension is then dried by azeotropic distillation and the particles are separated from the non-aqueous liquid in conventional manner. The desired particle size range is controlled in known manner, for instance by the choice of stabiliser, emulsifying agent (if present) and, especially, the degree of agitation during the formation of the initial suspension of aqueous monomer particles in the water immiscible liquid. The beads are substantially spherical.

Some reverse phase polymerisation methods involve the use of relatively large amounts of emulsifiers or other materials that depress surface tension. It is particularly desirable in the invention to make the polymer particles in the substantial absence of any such material. In particular, it is desirable that the entire binder (and also the polymer component of the binder) should have substantially no depressant effect on surface tension. Thus if binder is dissolved with water at 20° C. at 0.075% by weight concentration the surface tension of the solution should be above 65, and preferably above 70 dynes/cm. Thus it is preferred to avoid the use of amounts of surfactant that would depress surface tension significantly and reliance should be placed instead on agitation or stabiliser, in known manner, to control bead size.

Although it might have been expected to be desirable to use swellable but insoluble particles (in an attempt at matching the properties of bentonite) in fact the use of such polymer as the only polymer is unsatisfactory and soluble polymer must be used.

The failure of the cross-linked polymers, and the article in Mining Engineering October 1984 page 1438, might have indicated that it is necessary for the polymer to go into solution and/or to form a viscous phase during mixing, but we have surprisingly found that results can be improved (or the required polymer dose reduced) by the presence in the water of certain simple compounds. Many of these are monomeric, usually inorganic, electrolyte that can be shown experimentally to reduce the rate of solution and the viscosity when the polymer is dissolved into bulk water. However it appears that some mechanism other than depression of solubility or viscosity is involved. In practice the water is generally moisture that is present in the ore, remaining from a previous filtration stage, and this water is itself normally a solution of one or more inorganic electrolytes.

Although this contamination appears satisfactory we find results are improved further, and often synergistically, if the powdered binder that is added to the ore includes additional monomeric compound that is usually an inorganic or organic electrolyte but can be a non-electrolyte. The compound amount typically is from about 5 to about 60% by weight based on the polymer.

The compound is normally water soluble and inorganic and so is preferably a water soluble salt of an acid. However salts of strong acids (e.g, sodium chloride, sulphate or nitrate) are less satisfactory than salts of weak organic acids or carbonic acid. The strong acid salts may generate corrosive acids during smelting or firing. Accordingly preferred compounds that are incorporated as part of the binder are organic molecules such as urea, inorganic water soluble salts of carboxylic, dicarboxylic and tricarboxylic acids such as sodium acetate, sodium citrate, sodium oxalate, sodium tartrate, sodium benzoate and sodium stearate, other sodium salts of weak acids such as sodium bicarbonate and sodium carbonate, other miscellaneous sodium salts such as sodium silicate, the corresponding ammonium, potassium, calcium or magnesium salts of the preceding salts and calcium oxide. Sodium carbonate, bicarbonate or silicate are generally preferred as they give the best anti-spalling and dry strength results.

An important advantage of the invention is that the beads made by reverse phase bead polymerisation can readily be added in very uniform and very small amounts to the ore that is to be pelleted, because of the substantially spherical shape of the beads. If the binder is to be a blend of the polymer with other material such as any of the compounds discussed above then this other material should also be added in a form that is easily flowable on to the ore. Preferably the compound is incorporated in the beads. For instance a salt of a weak acid can be present in the aqueous monomer during polymerisation. Alternatively the compound can be added separately to the ore or it can be preblended with the polymer beads, but in either instance the compound itself is preferably put into a free flowable, generally bead, form, by known techniques.

The optimum amount of added salt or other compound can be found by experimentation. For many purposes it is in the range 0 to about 60% by weight based on the binder (below 0.1% and usually below 0.02% based on ore). In some instances amounts of from about 10 to about 30% based on soluble polymer are the most cost effective but usually greater amounts, for instance 30 to about 100% or even 150%, preferably 50 to 90%, based on soluble polymer are preferred.

The soluble polymer, optionally with the added salt or other compound, can be used in combination with other binders. In particular, despite the fact that cross linked polymers have proved, by themselves, to be unsatisfactory we find valuable results are achieved if a cross linked, swellable, particulate organic polymer is included with the soluble polymer. The cross linked polymer must have a small particle size, below 100 μm and often below 50 μm. The size can be as small as is commercially available, e.g., down to 10 μm or 1 μm. The particles are normally introduced as dry powder and preferably this powder is in the form of bead fines separated during the production of coarser particulate swellable polymer as produced by bead polymerisation. The inclusion of the cross linked polymer particles can give surprisingly improved dry strength and drop number values and so a blend of soluble particles and cross linked particles can give an excellent combination of dry strength, wet strength and spalling properties. Also the pellets tend to have improved surface appearance, such as smoothness.

The cross linked polymer may be non-ionic (e.g., polyacrylamide), but when the soluble polymer is ionic it is preferably of the same ionic type as the soluble polymer and so may be formed from the same monomers as are discussed below for the preparation of the soluble polymer. Preferably 20 to 100% by weight, most preferably 60 to 100% by weight, are ionic. The use of homopolymer, e.g., cross linked sodium polyacrylate, is very satisfactory. Cross linking may be by any of the conventional cross linking agents used in the production of swellable or absorbent polymers. Thus it may be by an ionic cross linking agent but is preferably covalent, e.g., methylene bis acrylamide or other polyethylenically unsaturated monomer. The amount of cross linking agent is generally in the range 20 to 1,000 ppm, preferably 50 to 500 ppm, and must be such that the particles are insoluble but highly swellable in water, e.g., having a gel capacity in water above 50, and preferably above 200, grams per gram.

The amount of cross linked polymer particles may be relatively low, e.g., 10 to 30% based on soluble polymer, but generally greater amounts, e.g., up to 300% or even 600% based on soluble polymer are preferred. Amounts of 0 to 80% often 20 to 50%, based on total binder are suitable. Particularly preferred binders consist essentially of 1 part by weight soluble polymer, 0.3 to 1.5 parts by weight sodium carbonate or other added salt or simple compound, and 0.3 to 5 parts by weight cross linked anionic homopolymer or copolymer, with proportions of about 1:1:1 often being convenient.

Substantially all the particles of the soluble polymer (and of other binder particles) must be below about 300 μm for good results, presumably since otherwise the particle size is too large to establish adequate contact with the very large number of very small iron ore particles. Preferably substantially all the polymer particles are below about 200 and preferably below about 150 microns. Although it might be expected to be necessary to have exceedingly small polymer particle size, similar to bentonite, this is unnecessary and it is satisfactory for most or all of the particles to be above 20 microns. Best results are often achieved when substantially all the polymer particles are in the range 20 to 100 microns but a satisfactory fraction is 100% below about 200 μm and at least 50% below about 100 μm.

An important feature of the invention is that despite the very low particle size, and therefore huge surface area, of the ore good results are achieved at very low soluble polymer additions. The amount, therefore, is usually below about 0.2% and generally it is below about 0.1% (by weight based on the total mix). It is often preferred for the amount to be below 0.05% by weight, but amounts below 0.01% are usually inadequate except when the soluble polymer is used with significant (e.g., at least 20% by weight) other binder components. the amount of soluble polymer may then sometimes be reduced, e.g., to 0.005%.

The particle size of the ore is generally less than 250 microns, usually 90% or 80% by weight of the particles being less than 50 microns. The ore is preferably an iron ore such as magnetite, haemetite or taconite, but can be any other mineral ore that needs to be put into the form of pellets, for instance a zinc ore. The ore can be contaminated with clay and it is surprising that, despite the water absorbing capacity of such clay, satisfactory results are still obtained in the invention.

Before adding the polymer the ore usually already has the desired final moisture content of 5 to 15%, preferably 8 to 10%, by weight based on the weight of iron ore. This moisture content is the moisture as measured by heating up to 105° C. However if the ore is too dry then water may be added to it, e.g., before or after the addition of polymer binder.

The binder can be blended with the ore in the same manner as bentonite is blended, preferably by scattering the polymer particles on to the ore as it is carried towards a mixer, for instance a paddle mixer provided with stators. It may be mixed for the same duration as when bentonite is used, for instance 2 to 20, generally about 10, minutes.

The damp blend of ore and polymer particles is converted to pellets in conventional manner, for instance by balling in conventional manner. This may be effected using a rotating tilting disc but generally is conducted in a balling drum. The size of the pellets is generally from 5 to 16 mm, preferably 8 to 12 mm.

Before the resultant green pellets can be utilised for the production of metal they need to be fired, generally at a temperature up to above 1000° C., for instance up to 1200° C. For this purpose they can be introduced into a kiln or other firing apparatus and fired in conventional manner. It is desirable to be able to introduce them into this furnace at the highest possible inlet temperature with the minimum risk of spalling. The inlet temperature at which spalling becomes significant can be referred to as the spalling temperature and a particular advantage of the invention is that it is possible to make pellets having a spalling temperature higher than can conveniently be obtained by the use of bentonite and other known binders.

By the invention, good results can be achieved while using easy application techniques and low amounts of polymer. It is easy to make pellets which have satisfactorily high wet strength and dry strength (measured after drying in an oven) and a satisfactorily high drop number when wet (indicating the number of drops before they shatter). In particular it is possible to obtain excellent spalling properties, often much better than are obtainable with bentonite.

The soluble polymer may be any synthetic polymer that is capable of acting as a binder for ore pellets and so may be non-ionic, anionic or cationic. Examples are given in GB No. 1,324,838. Optimum results require that the polymer should be selected having regard to the pH or ionic surface properties of the ore. Often it is a polymer of one or more water soluble ethylenically unsaturated monomer.

When the ore is conventional iron ore, or other mineral ore having a conventional pH such as 8.1, typically 8.2 to 8.4 or higher, we find that best results are obtained when the soluble polymer is anionic. Preferably it is formed from a blend of anionic and non-ionic monomers. The monomers are generally acrylic but could be other vinyl or allyl monomers provided the final polymer is water soluble and has the desired intrinsic viscosity. The polymer is preferably formed from a blend of acrylamide and one or more anionic ethylenically unsaturated monomers. The amount of acrylamide is generally in the range 20 to 95% by weight of the monomers. The anionic monomer or monomers can include sulphonic monomers but preferably are carboxylic monomers. Accordingly various of the water soluble carboxylic (including polycarboxylic) ethylenically unsaturated acids can be used, including methacrylic acid, but acrylic acid is preferred. Any acid is generally present in the form of a water soluble salt, usually the sodium salt.

The polymer is usually made by polymerisation of the monomer or monomer blend that is required to form the final polymer chemical type, but it is also possible to form the polymer and then post-react it to form the desired chemical type. For instance a polyacrylamide polymer may be formed and then hydrolysed to form anionic polymer in known manner.

The amount of anionic monomer is generally at least about 5% and preferably at least about 20% but generally it is unnecessary for it to be present in an amount of more than about 50% or, at most, about 60%. Particularly preferred copolymers are formed by polymerisation of 30 to 40 or 50% by weight sodium acrylate and 50 or 60% up to 70% by weight acrylamide.

We have found that the IV can influence final properties. Generally it should be at least about 3 as otherwise rather large amounts are required to give adequate strength and preferably it is above 4. Similarly, results may deteriorate if the intrinsic viscosity is too high, and so it is generally below 13 and preferably below about 11. With increasing IV, smaller amounts of polymer may be used but the proportions have to be selected more carefully for optimum properties. Preferably the intrinsic viscosity is above about 5 and preferably it is below about 8 or 9, with best results generally around 6, for instance in the range about 6 to about 8. These values are especially applicable to anionic copolymers. With some polymers, especially homopolymers, lower IV values are suitable, e.g., down to 0.2 dl/g.

Although some of the preferred processes of the invention involve the use of anionic copolymer having IV above 3 dl/g for pelleting conventional iron ores, the invention includes the pelleting of other ores and the use of other polymer types. In particular, although the defined anionic polymers are proving to be very satisfactory for use on conventional iron ores we have found surprisingly that they give less satisfactory results with some unusual ores, for instance one particular type of haematite iron ore in Canada. It would therefore be desirable to be able to provide a synthetic polymeric binder that is suitable on such ores as a replacement for the bentonite which is at present used.

In studying this problem we have ascertained that this particular ore as supplied to the pelleting plant has a much lower pH than normal pelleting ores. Since observing this we have also found that if an ore is rendered highly acidic, for instance by leaching with acid, then bentonite also is found once again to be unsatisfactory. We have now surprisingly found that all these low pH ores can very satisfactorily be pelletised using a cationic polymeric binder.

Accordingly, the beads of soluble polymer are preferably beads of soluble cationic polymer when the ore is an ore which gives a pH of below 8.

When a small amount, e.g., 2 to 10% by weight, of particulate ore is slurried with water the pH of the resultant water may depend upon the amount of ore that is used but at higher amounts of ore, typically 30 to 40% solids, the pH becomes substantially independent of the amount of ore. It is this pH, that is substantially independent of ore concentration, to which we refer when we say that the ore gives a specified pH. Normal ores give a pH of above 8.1, typically 8.2 to 8.4 or higher. The invention is of particular value when the ore gives a pH of below 7.5, and especially when it gives a pH of below 7. At pH values in the range 7 to 8 it may be possible to obtain adequate pelleting results using large amounts of bentonite but at lower pH values, for instance between pH 6.5 and pH 4 or even down to pH 3 or lower bentonite is generally wholly incapable of giving adequate results, but good results are obtainable in the invention.

The mineral can be any acidic ore, e.g., a zinc ore, but is preferably an iron ore, normally a haematite, magnetite or tachonite. The ore may be naturally acidic or may have been rendered acidic by some treatment prior to blending with the binder. For instance the ore may have been washed with acid to remove acid soluble components, typically to produce a pH of from 5 to 6 if manganese is being washed out of the ore.

The ore may have acquired an acidic pH during other processing treatments. For instance the ore may be dried under conditions that result in the dry ore giving the specified relatively low pH in water. This may be because, for instance, the drying is conducted using hot gases that contain sulphur or other impurities that cause acidification of the ore during drying or may be due to chemical changes in the surface properties of the ore that are caused by dehydration.

The soluble cationic polymer is formed by the polymerisation of cationic ethylenically unsaturated monomer, optionally with other ethylenically unsaturated monomers. The monomer or monomer blend will normally be water soluble. One suitable class of cationic monomers are the dialkylaminoalkyl (meth) acrylates, especially dimethylaminoethyl (meth) acrylate (DMAEA or DMAEMA). Another suitable class are the dialkylaminoalkyl (meth) acrylamides. A suitable material is dimethylaminopropyl (meth) acrylamide. All such monomers are generally present in the form of acid addition or quaternary ammonium salts. For instance a suitable monomer is methacrylamido propyl trimethyl ammonium chloride (MAPTAC). Other suitable cationic monomers include diallyl dialkyl quaternary monomers, especially diallyl dimethyl ammonium chloride (DADMAC). Preferred cationic polymers are polymers having recurring quaternary ammonium groups. Blends of cationic polymers (e.g., a blend of synthetic cationic with natural or modified natural cationic polymer) can be used.

The polymers can be copolymerised with non-ionic monomers, generally (meth) acrylamide (ACM). Other suitable cationic polymers are polyethylene imines and epichlorhydrin polyamine reaction products made in bead form. We find that homopolymers and other polymers having a very high cationic content can be of relatively low molecular weight, for instance having intrinsic viscosity below 5 dl/g, often in the range 0.4 to 2 dl/g. When such polymers are formed from ethylenically unsaturated monomers at least 70 weight percent, and preferably at least 90 weight percent, of the monomers should be cationic, and preferably the polymer is substantially a homopolymer.

Other preferred polymers have medium to high molecular weight and medium cationic content. For instance the IV may be from 3 to 20 dl/g, generally 3 to 12 dl/g, preferably from 5 to 9 dl/g. Such polymers are best made by copolymerisation of about 20 to about 75, preferably about 25 to about 60, weight percent cationic monomer with a non-ionic monomer such as acrylamide. Best results are generally obtained with about 35 to about 55 weight percent cationic monomer, with the balance non-ionic.

Although best results are achieved most easily when the cationic polymer is added in the form of water soluble beads all below 300 microns, as discussed above, in some instances the cationic polymer can be added in other forms. Thus it can be added in the form of particles that are within the size ranges discussed above for beads but which have been made by comminution of gel in air or, preferably, in an organic liquid for instance as described in EP No. 169674. It may be necessary to sieve the particles to give the desired particle range and to exclude oversize particles.

Instead of being a synthetic polymer, it can be a naturally occurring polymer (or a modified natural polymer) such as Chitosan or cationic starch.

When the ore is wholly dry, or is drier than is required in the moist pelleting mixture, it is necessary to add water to the ore in order to form the moist mixture and it is then possible to incorporate the polymer as a solution in this water. For this purpose the polymer can initially be provided in any suitable physical form. When the polymer is being added as a solution, the aqueous polymer solution may be sprayed on to the ore prior to pelleting. The solution can be made from polymer in the form of a concentrated solution, a polymer-in-oil dispersion or powder. Alternatively the polymer-in-oil dispersion of the polymer can be added direct to the ore. The polymer particles in any such dispersion can be dry or can be swollen gel particles.

The following are some examples demonstrating the invention. The ore used in each of Examples 1 to 5 gave a pH in water of above 8.1.

EXAMPLE 1

A linear copolymer of acrylamide with 35 to 40 weight percent sodium acrylate was made by reverse phase bead polymerisation followed by azeotropic distillation and screening in conventional manner. One grade of polymer, polymer A, was made to an intrinsic viscosity of 6.9 and another, polymer B, was made to an intrinsic viscosity of 10.7.

Each of the polymer types was screened to various maximum particle sizes and each polymer fraction was then used as a binder for particulate iron ore. The polymer beads were scattered on to moist particulate magnetite iron ore at a dosage of about 0.04% by weight. The amount of moisture was 8.8%. The blend was then converted to pellets in a balling drum, the pellets having a size typically of about 5–16 mm. The properties of the pellets made from polymer A are recorded in Table 1 and the properties of the pellets made from polymer B are recorded in Table 2.

TABLE 1

| Particle size/ μm | Wet Strength/ kg | Dry Strength/ kg | Drop Number | % Moisture | % Porosity | Spalling Temp/ °C. |
|---|---|---|---|---|---|---|
| −425 | 0.80 | 2.64 | 7.8 | 9.1 | 32.6 | +600 |
| −250 | 0.80 | 2.58 | 6.7 | 8.9 | 32.6 | +600 |
| −75 | 0.84 | 2.80 | 8.3 | 8.9 | 32.2 | +600 |

TABLE 2

| Particle size/ μm | Wet Strength/ kg | Dry Strength/ kg | Drop Number | % Moisture | % Porosity | Spalling Temp/ °C. |
|---|---|---|---|---|---|---|
| −600 | 0.85 | 2.32 | 8.0 | 8.9 | 32.6 | +600 |
| −425 | 0.77 | 1.84 | 7.4 | 9.0 | 32.9 | +600 |
| −250 | 0.80 | 2.24 | 9.0 | 9.0 | 32.6 | +600 |
| −150 | 0.88 | 2.38 | 8.8 | 8.9 | 32.4 | +600 |
| −75 | 0.97 | 2.90 | 10.2 | 8.9 | 32.1 | +600 |
| −38 | 0.88 | 2.73 | 9.4 | 9.0 | 32.4 | +600 |

The benefit of using the lowest particle sizes is demonstrated in both tables by the increased wet strength at lower particles sizes. The benefit of using a polymer having IV 6.9, rather than 10.7, is demonstrated by the improved dry strength in Table 1. All these polymers are resistant to spalling to above 600° C., which is very high compared to bentonite and to the temperature of 250° C. quoted by de Souza.

EXAMPLE 2

The process of Example 1 was repeated with various binders. The polymer had IV about 10 and was a copolymer of about 40% sodium acrylate with about 60% acrylamide. Table 3 shows the results for binders consisting of a single component and Table 4 shows the results for 0.04% additions of binder consisting of a blend of polymer:inorganic additive in the ratios specified in Table 4.

TABLE 3

| Binder | Amount Binder % w/w | Wet Strength/ 4 g Pellet/kg | Dry Strength/ 4 g Pellet/kg | Drop No. | % Moisture | % Spalled at 1000° C. |
|---|---|---|---|---|---|---|
| Blank | | 0.42 | 0.47 | 3.0 | 7.4 | 100 |
| Bentonite | 0.7 | 0.67 | 2.06 | 5.7 | 8.3 | 20 |
| Polymer | 0.04 | 0.53 | 1.27 | 4.6 | 8.4 | 0 |
| $NaHCO_3$ | 0.7 | 0.60 | 1.43 | 3.3 | 7.2 | 0 |
| $Na_2CO_3$ | 0.7 | 0.42 | 1.47 | 3.8 | 7.7 | 20 |
| $Na_3$ Citrate | 0.7 | 0.40 | 6.02 | 3.9 | 7.4 | 0 |
| $NaNO_3$ | 0.7 | 0.42 | 0.67 | 3.7 | 7.5 | 60 |
| $CaCO_3$ | 0.7 | 0.54 | 0.30 | 2.9 | 7.6 | 100 |

TABLE 4

| Additive | Ratio | Wet Strength/ 4 g Pellet/kg | Dry Strength/ 4 g Pellet/kg | Drop No. | % Moisture | % Spalled at 1000° C. |
|---|---|---|---|---|---|---|
| $NaHCO_3$ | 95:5 | 0.59 | 1.38 | 8.7 | 8.6 | 20 |
| $NaHCO_3$ | 90:10 | 0.59 | 2.20 | 6.9 | 8.3 | 0 |
| $NaHCO_3$ | 80:20 | 0.67 | 1.21 | 7.1 | 8.3 | 0 |
| $NaHCO_3$ | 60:40 | 0.48 | 0.75 | 4.6 | 8.7 | 40 |
| $Na_2CO_3$ | 90:10 | 0.64 | 2.16 | 6.6 | 8.5 | 0 |
| $Na_2CO_3$ | 80:20 | 0.56 | 1.18 | 9.9 | 8.7 | 0 |
| $Na_2CO_3$ | 70:30 | 0.50 | 1.14 | 11.9 | 8.6 | 0 |
| $Na_3$ Citrate | 90:10 | 0.44 | 1.72 | 15.4 | 8.7 | 0 |
| $Na_3$ Citrate | 80:20 | 0.45 | 1.42 | 10.7 | 8.5 | 0 |

Table 3 clearly demonstrates the improved spalling resistance of the polymer of the invention compared to bentonite and Table 4 shows the benefit of an addition, typically 10–20%, of the electrolyte.

EXAMPLE 3

The process of Example 1 was repeated with different binders, to give the results in Table 5. The organic binders were used in amounts of 0.07% by weight and were fine powder particles.

TABLE 5

| | Wet Strength/ kg | Dry Strength/ kg | Drop No. | % Moisture |
|---|---|---|---|---|
| Blank | 0.60 | 0.50 | 1.4 | 7.3 |
| 60% ACM/40% NaAc (IV = 11.1) | 0.60 | 4.20 | 5.6 | 9.2 |
| Bentonite (0.7% w/w) | 0.88 | 2.95 | 1.7 | 7.7 |
| Carboxymethyl cellulose | 0.81 | 2.65 | 2.4 | 8.1 |
| Cross linked anionic polymer | 0.41 | 0.59 | 1.6 | 8.8 |
| Cationic polymer blend | 0.59 | 0.83 | 2.5 | 8.6 |

Satisfactory results have also been obtained using, as binder a 60:40 acrylamide:sodium acrylate polymers having IV 3.6 and good results have been obtained at IV about 6 and about 8. These polymers, and a copolymer of 30:70 acrylamide:sodium acrylate IV 7.8, gave better results than acrylamide homopolymer. All the polymers that were small soluble beads were easy to apply uniformly by scattering.

EXAMPLE 4

A copolymer of 60% acrylamide 40% sodium acrylate with IV about 6.8 in powder form 100% below 200 μm was used blended with sodium carbonate as a binder. A, in a commercial iron ore pelletisation plant. In a comparative test, B, bentonite was used. The results are in Table 6. The strength values in test A are satisfactory in view of the very low amount of binder that was used. The spalling temperature is remarkably high and this shows a great benefit of the invention.

TABLE 6

| | A | B |
|---|---|---|
| Binder addition kg/ton | | |
| Polymer | 0.22 | |
| Soda $Na_2CO3$ | 0.15 | |
| Bentonite | | 7.0 |
| Green ball property | | |
| Moisture % | 9.1 | 9.1 |
| Drop number | 8.5 | 8.6 |
| Compression strength | | |
| Wet (kp) | 0.71 | 0.90 |
| Dry (kp) | 2.07 | 4.50 |
| Spalling temp °C. | >800 | 370 |
| Porosity % | 33.7 | 32.8 |
| Pellets property | | |
| Cold compression strength (kp) | 215 | 266 |
| Tumber Index | 95 | 97 |

EXAMPLE 5

The process of Example 1 was repeated using no added binder (blank) or a blend of 0.02% w/w particles <200 μm of soluble polymer IV 6.8 formed from 60% acrylamide and 40% sodium acrylate with 0.1% w/w or 0.05% w/w particles below 100 μm of cross linked sodium polyacrylate. The results were as follows.

TABLE 7

| Binder | Wet Strength | Dry Strength | Drop No. | % Moisture |
|---|---|---|---|---|
| Blank | 0.42 | 0.40 | 3.0 | 7.4 |
| 0.1% cross linked | 0.68 | 3.03 | 27.1 | 11.5 |
| 0.05% cross linked | 0.67 | 1.61 | 13.3 | 9.5 |

In examples 6 and 7 below the binders were each scattered on to acidic moist particulate haematite iron ore at an appropriate dosage. The moisture content was 8.3%. The blend was then converted to pellets in a balling drum, the pellets having a size typically of about 5-16 mm.

The following synthetic cationic polymeric binders were used. They were made by reverse phase polymerisation to a bead size below 200 μm and the beads were dried and separated.

Polymer A: copolymer of 40% MeCl quaternised DMAEA with 60% ACM
IV ~ 7-8 $dlg^{-1}$ Polymer B: copolymer of 50% MAPTAC with 50% ACM
IV = 6.9 $dlg^{-1}$ Polymer C: 100% PolyMAPTAC
IV = 1.3 $dlg^{-1}$ Polymer D: copolymer of 60% MeCl quaternised DMAEA with 40% ACM
IV ~ 6-7 $dlg^{-1}$ Polymer E: copolymer of 80% MeCl quaternised DMAEA with 20% ACM
IV ~ 8-9 $dlg^{-1}$ Polymer F : 100% PolyDADMAC solid grade
IV = 0.7 $dlg^{-1}$

EXAMPLE 6

An ore from the Wabush mine was dried, giving a pH of 6.2, and was blended while moist with the binder. The wet strength, dry strength, drop number and spalling temperatures were recorded, as shown in Tables 8 and 9 below.

TABLE 8

| | Dose % w/w | Wet Strength/ kg | Dry Strength/ kg | Drop Number | % Moisture |
|---|---|---|---|---|---|
| Blank | — | 0.56 | 0.59 | 7.9 | 8.0 |
| Bentonite | 0.7 | 1.17 | 8.20 | 18.5 | 10.0 |
| Peridur | 0.04 | 0.56 | 0.14 | 9.2 | 8.7 |
| Polymer A | 0.04 | 0.92 | 1.24 | 22.7 | 8.8 |
| Polymer B | 0.04 | 0.72 | 1.82 | 19.2 | 9.4 |
| Polymer C | 0.1 | 0.86 | 3.31 | 8.2 | 8.2 |

TABLE 9

| | % Spalled | | |
|---|---|---|---|
| | 700° C. | 850° C. | 1000° C. |
| Blank | 0 | 70 | 100 |
| Bentonite | 40 | 50 | 100 |
| Peridur | — | 100 | — |
| Polymer A | — | 0 | 80 |
| Polymer B | — | 10 | 100 |
| Polymer C | 0 | 0 | 70 |

EXAMPLE 7

An acid leached iron ore having pH about 5 was used and the following results were obtained.

TABLE 10

| | Dose % w/w | Wet Strength/ kg | Dry Strength/ kg | Drop Number | % Moisture |
|---|---|---|---|---|---|
| Polymer A | 0.04 | 0.49 | 1.61 | 8.2 | 8.9 |
| B | 0.04 | 0.50 | 2.15 | 16.9 | 9.1 |
| D | 0.04 | 0.58 | 2.11 | 6.8 | 8.0 |
| E | 0.04 | 0.51 | 1.94 | 5.4 | 7.8 |
| F | 0.1 | 0.48 | 3.50 | 4.2 | 7.9 |

Spalling was tested for all binders at 850° C. and for binders B, E and F at 1000° C. No spalling occurred.

We claim:

1. A process in which mineral ore pellets are made by adding binder comprising organic polymer to particulate iron ore having substantially all particles below 250 μm and stirring in the presence of 5 to 15% by weight water (based on total mix) to form a substantially homogeneous moist mixture and pelleting the moist mixture, and in which the binder comprises about 0.002% to about 0.5% by weight, based on total mix, of a water soluble synthetic polymer and that is added to the ore as dry, free flowing beads that are substantially all above 20 μm and below 300 μm and that are made by reverse phase bead polymerisation from a water soluble ethylenically unsaturated monomer or blend of monomers.

2. A process according to claim 1 in which the binder gives a surface tension of above 70 dynes/cm at a concentration in water at 20° C. of 0.075%.

3. A process according to claim 1 in which at least 70% by weight of the iron ore has a particle size below 50 μm.

4. A process according to claim 1 in which substantially all the polymer beads are below 150 μm.

5. A process according to claim 1 in which substantially all the polymer beads are below 200 μm and at least 50% by weight are below 100 μm.

6. A process according to claim 1 in which the ore is an iron ore that gives a pH in water of above 8 and the soluble polymer is an anionic polymer that has intrinsic viscosity of from 3 to 16 dl/g.

7. A process according to claim 1 in which the ore gives a pH in water of below 8 and the soluble polymer is a cationic polymer.

8. A process according to claim 1 in which the binder consists essentially of the soluble polymer beads and other additives selected from cross linked polymers and monomeric compounds, and in which the said other additives are present as beads of below 300 μm size.

9. A process in which mineral ore pellets are made by adding binder comprising organic polymer to particulate iron ore having substantially all particles below 250 μm and stirring in the presence of 5 to 15% by weight water (based on total mix) to form a substantially homogeneous moist mixture and pelletising the moist mixture, and in which the binder comprises about 0.002% to about 0.5% by weight, based on total mix, of a water soluble synthetic polymer that is cationic and the ore gives a pH in water of below 8.

10. A process according to claim 9 in which the cationic polymer is selected from polymers that have intrinsic viscosity 0.4 to 5dl/g and that are formed from monomers of which at least 70% by weight are cationic, and polymers that have intrinsic viscosity of 3 to 20 dl/g and that are formed by copolymerisation of 20 to 75 weight percent cationic monomer with 80 to 25 weight percent non-ionic monomer.

11. A process according to claim 9 in which the cationic polymer is substantially a homopolymer having intrinsic viscosity 0.4 to 2 dl/g.

12. A process accroding to claim 9 in which the cationic polymer is a copolymer of 25 to 60 weight percent cationic monomer with 75 to 40 weight percent acrylamide and has IV 3 to 12.

13. A process according to claim 9 in which the cationic polymer is a substantial homopolymer of monomers selected from diallyl dimethyl ammonium chloride and quaternised dialkylaminoalkyl (meth) acrylates and quaternised dialkylaminoalkyl (meth) acrylamides and has intrinsic viscosity 0.4 to 2 dl/g.

14. A process according to claim 9 in which the cationic polymer is a copolymer of about 20 to about 60% acrylamide with about 80 to about 40% by weight of a quaternised monomer selected from dialkylaminoalkyl (meth) acrylates and dialkylaminoalkyl (meth) acrylamides and has intrinsic viscosity of from 3 to 12 dl/g.

15. A process according to claim 9 in which the ore is iron ore which gives a pH in water of below 7.

16. A process according to claim 9 in which the polymer is added to the ore as dry free flowing powder having substantially all particles above 20 μm and below 300 μm.

17. A process according to claim 9 in which the polymer is added in the form of beads made by reverse phase suspension polymerisation and that are substantially all above 20 μm and below 300 μm.

18. A process according to claim 17 in which the binder gives a surface tension of above 70 dynes/cm at a concentration in water at 20° C. of 0.075% by weight.

19. A process according to claim 9 in which the amount of polymer is from 0.01 to 0.05% by weight.

20. A process according to claim 9 in which at least 70% by weight of the iron ore has a particle size below 50 μm.

21. A process according to claim 17 in which substantially all the polymer particles are below 150 μm.

22. A process according to claim 17 in which substantially 100% of the polymer particles are below 200 μm and at least 50% are below 100 μm.

* * * * *

UNITED STATES PATENT AND TRADEMARK OFFICE

CERTIFICATE OF CORRECTION

PATENT NO. : 4,728,537

DATED : March 1, 1988

INVENTOR(S) : Anthony P. Allen et al.

It is certified that error appears in the above-identified patent and that said Letters Patent is hereby corrected as shown below:

The term of this patent subsequent to August 4, 2004, has been disclaimed.

Signed and Sealed this

Thirty-first Day of May, 1988

*Attest:*

DONALD J. QUIGG

*Attesting Officer*

*Commissioner of Patents and Trademarks*